US006874727B2

(12) United States Patent
Le Viavant

(10) Patent No.: US 6,874,727 B2
(45) Date of Patent: Apr. 5, 2005

(54) GUIDING DEVICE FOR A BAND-TYPE PRODUCT

(75) Inventor: Germain Le Viavant, Beauchamp (FR)

(73) Assignee: Vai Clecim - Le Polyedre, Nanterre Cedex (FR)

( * ) Notice: Subject to any disclaimer, the term of this patent is extended or adjusted under 35 U.S.C. 154(b) by 0 days.

(21) Appl. No.: 10/459,707

(22) Filed: Jun. 12, 2003

(65) Prior Publication Data

US 2003/0230619 A1 Dec. 18, 2003

(30) Foreign Application Priority Data

Jun. 13, 2002 (FR) ..... 02 07317

(51) Int. Cl.[7] ..... B65H 23/04; B65H 23/32

(52) U.S. Cl. ..... 242/615.2; 242/615.21; 226/21; 226/189

(58) Field of Search ..... 242/615.2, 615.21, 242/189, 21; 226/189, 21

(56) References Cited

U.S. PATENT DOCUMENTS

| | | | | |
|---|---|---|---|---|
| 3,095,131 A | * | 6/1963 | Robertson et al. | 226/190 |
| 3,827,617 A | * | 8/1974 | Anderson | 226/196.1 |
| 4,131,925 A | * | 12/1978 | Firth et al. | 360/130.21 |
| 4,687,125 A | | 8/1987 | Hashimoto et al. | 226/21 |
| 5,480,499 A | * | 1/1996 | Wangerin et al. | 148/657 |
| 5,823,464 A | * | 10/1998 | Bohn et al. | 242/615.21 |
| 6,058,844 A | * | 5/2000 | Niemiec | 101/488 |
| 6,457,623 B1 | * | 10/2002 | Rey | 226/189 |

OTHER PUBLICATIONS

Abstract only of Japanese Patent 58135049, Aug. 11, 1983, "Advancing Direction Changing Device Of Band Material", Shimozato Yoshio.

Abstract only of Japanese Patent 59179210, Oct. 11, 1984, "Device For Turning Direction Of Strip", Nakamura Koji.

Abstract only of Japanese Patent 59229230, Dec. 22, 1984, "Device For Changing Advancing Direction Of Strip", Nakamura Koji.

Abstract only of Japanese Patent 06298431, Oct. 25, 1994, "Device For Varying Direction Of Advance Of Band-Shaped Material", Hamamoto Koichi.

Abstract only of Japanese Patent 06298432, Oct. 25, 1994, "Device For Varying Direction Of Advance Of Band-Shaped Material", Hamamoto Koichi.

* cited by examiner

*Primary Examiner*—Eileen D. Lillis
*Assistant Examiner*—Evan Langdon
(74) *Attorney, Agent, or Firm*—Arent Fox, PLLC

(57) ABSTRACT

The invention relates to a device for guiding a band-type product (1) especially a metal band, comprising at least two conical deflectors (2, 2') arranged head to foot.

According to the invention, each deflector (2, 2') comprises a fixed base (3, 3') whereon are mounted, in the manner of satellites, a plurality of rotating guiding rolls (4, 4') forming the same angle (A) with an axis (30, 30') of the deflector (2, 2'), and said deflectors (2, 2') are oriented relative to the longitudinal running axis (10) of the band (1) so that the latter comprises successively, in the running direction, an upstream portion (1*a*) tangent and perpendicular to an input generatrix (5*a*) on a first deflector (2), a central portion (1*b*) tangent and perpendicular, upwardly to an output generatrix (5*b*) of the first deflector (2) and, downwardly, to an input generatrix (5'*a*) on the second deflector (2') and a downstream portion (1*c*) tangent and perpendicular to an output generatrix (5'*b*) of the second deflector (2').

18 Claims, 2 Drawing Sheets

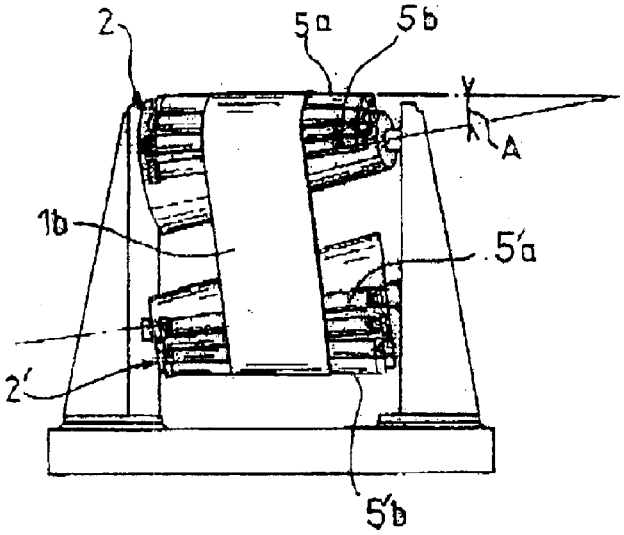
FIG.7
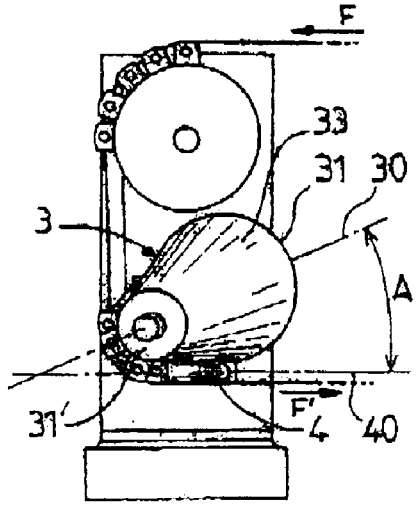
FIG.8
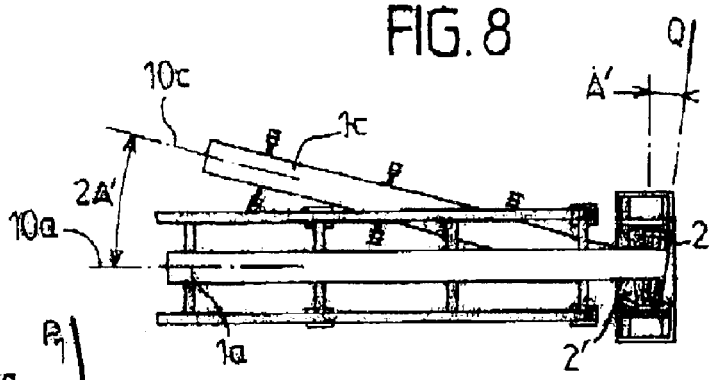
FIG.9
FIG.6
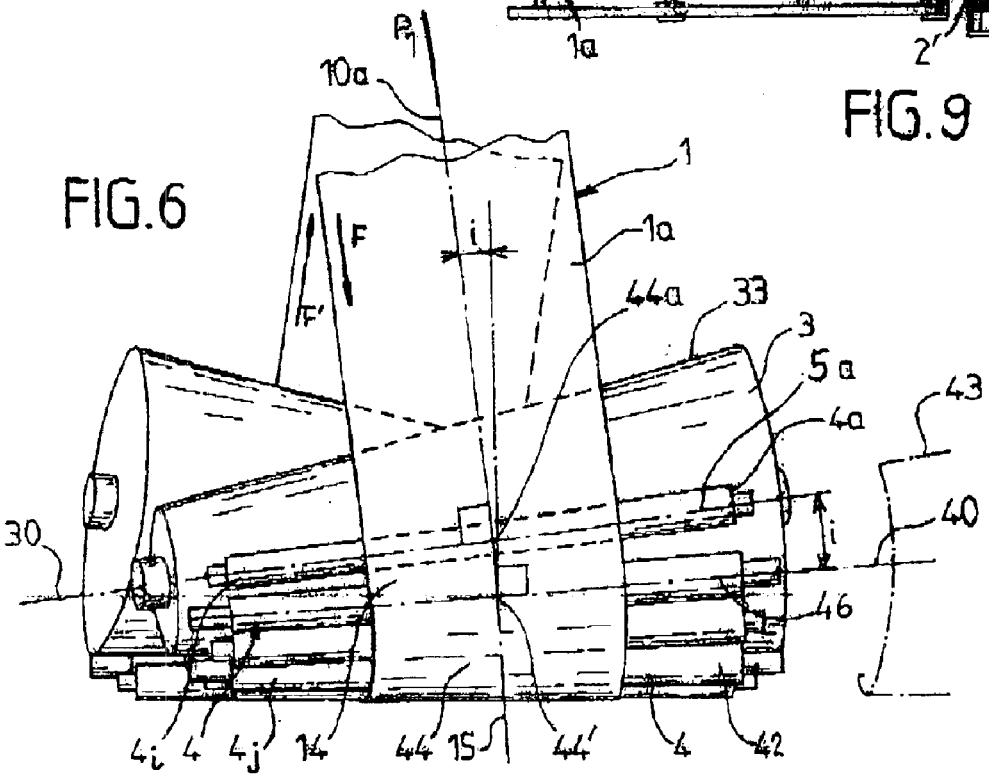

GUIDING DEVICE FOR A BAND-TYPE PRODUCT

The invention relates to a guiding device of a band-type product intended especially for production and treatment installations for hot and cold rolled metal bands.

Steel and metal industry makes available to the users and transformers various types of products having diverse dimensions and, in particular, flat products composed of sheets of variable thickness according to the usage, and which are generally wound into coils.

In order to produce such sheets and confer them the thickness required, so-called hot-rolling and cold-rolling operations are performed. Besides, the sheet must be subject to diverse treatments before rolling, such as scale removing, degreasing and etching, as well as finishing treatments.

These diverse treatments must obviously be realised in different installations. One may, for example carry out chemical etching by running the sheet in a succession of acid baths, annealing in an oven or cold-rolling in an installation comprising several successive stands operating in tandem.

Each treatment requires therefore a specific installation and a running speed adapted to the treatment. Consequently, until now, the diverse treatments had been normally carried out in separate sections, each associated with an unwinder and a winder placed, respectively, upstream and downstream in the running direction. In such a case, the band is unwound to pass through the treatment section, is then wound at the output of the latter while forming a coil which is transported towards the following treatment installation.

The weight of the coil depends obviously on the thickness of the sheet and on the length after winding, as well as on the nature of the metal, but it is still very significant.

For example, in the case of steel sheets, the weight of a coil is currently of 15 to 25 tons. There should therefore be provided lifting and handling vehicles adapted to the dimensions and to the weight of the coils to transport said coils from one treatment section to the next.

To reduce these handling operations and enhance productivity, it has been suggested for several years, to realise so-called continuous or semi-continuous production units wherein the band runs continuously in several successive treatment sections.

These different sections are, normally, placed after one another along the same running direction of the band and there results therefrom that the installation extends over a very great length. Moreover to compensate for variations. In speed between two successive sections, it is often necessary to interpose between said sections an accumulation device of a length of band which may reach several hundreds of metres.

Indeed, deflector rolls may be placed on the path of the band enabling to change the running level in order, for example, to superimpose several sections, but such a unit remains very cumbersome and requires, consequently, a very large surface area.

Besides, existing plants have often to be transformed by modernising certain portions of the installation and by connecting them together for continuous running of the band. It is then necessary to adapt to the configuration of the plant wherein the treatment sections which must be linked are not always aligned, the running directions in two successive sections often being different and able to be offset, transversally or in height. It is therefore necessary, in such a case, to impart to the band a change in direction which is more or less significant.

To do so, in a known arrangement, the band may form, between two successive treatment sections, a free-hanging loop between two deflector rolls whereof the axes may be oriented differently in order to modify the running direction.

However, a rather significant angle of deviation may be obtained without any risks of friction between both belts of the band only if the loop is wide enough, such an arrangement being, consequently, cumbersome.

Moreover, a free loop is only subject to its own weight and it is therefore necessary to arrange, upstream and downstream, stress application devices enabling to bring the traction load on the band to the value necessary in the other sections. This increases the space requirements of the installation and makes controlling the running of the band more complicated.

It is therefore sometimes difficult to integrate a free loop in an existing installation.

To solve such problems, it has already been suggested, in the document FR-A-2336331, to pass the band on several rolls placed at different levels and revolving round axes parallel to the same plane, but offset angularly. In such a case, as there are no free loops, the band can remain under stress, but the change in direction of a roll to the next causes a corresponding twist in the portion of the band comprised between both rolls, which is translated in an elongation of both edges of the band relative to the central portion.

This difference in elongation between the longitudinal fibres of the band may be compensated for by cambering the roll slightly in order to equalise the paths followed by the different longitudinal fibres.

However, for the differences in elongation between the central portion and the edges to be acceptable, the angular deviation should be relatively small, for example 20° and the centre distance between two consecutive rolls should be of the order of five times the width of the band. Consequently, for a deviation, for example, of 90°, the number of rolls should be multiplied. Moreover, the difference in level between two consecutive rolls should be of the order of 7 to 10 metres for a width of band ranging between 1.5 and 2 metres.

Such installations, which may be called "turning towers", remain therefore very cumbersome and rather costly.

For an angular change in direction of the longitudinal running axis of a band, it has also been suggested to use a conical deviation roll whereon the band is wound into a spiral. Such a device described, for example, in the document U.S. Pat. No. 4,687,125 is far less cumbersome than a turning tower as described in FR-A-2 336 331 and can therefore be attached to the existing framework of the mechanical equipment or stand directly on the ground, on a light framework.

In such a device, the band arrives, normally, close to the small base of the conical roll and moves gradually away toward the large base, during its rotation. The orientation of the band relative to the successive generatrices of the cone whereon it rests, varies gradually as well as the tangential speed and it is therefore necessary, to protect the band from any damage, to apply the latter on a set of rollers mounted rotatably round axes perpendicular to the running direction and which are distributed in series each defining a back-up generatrix of a virtual conical surface enveloping the set of rollers.

In known arrangements, the supporting rollers of the band are mounted on a fixed base. Their orientation and their spacing must therefore vary from one series to the other to follow the unwinding of the band. However, by reason of the conicity of the supporting surface, the band tends to slip and must therefore be maintained laterally. The use of two deflectors placed head to foot, as described in the document JP-A-59-229230 enables, however, to avoid this shortcoming.

In another arrangement, described in the document JP-A-59179210, a conical deflector rotating round an axis carries a plurality of satellite rolls which define successive back-up generatrices of the band. As the latter is winding into a spiral, each roll should move axially during the rotation of the deflector, to follow the displacement of the band toward the large base of the cone.

Such devices are therefore rather complex and costly and do not enable to prevent the band from slipping on its back-up members which may therefore be detrimental to its surface quality.

Moreover, to enable the rollers to rotate, the pressure applied to the band must be limited. However, a metal band is relatively rigid and, thus, must be subject to rather high stress for being applied on the rollers.

The invention aims at solving all these problems thanks to a simpler and cheaper device than the known devices and enabling, moreover, to maintain the orientation of the band relative to its back-up members while reducing the risks of slippage and of damage of its surface.

Moreover, such a device provides numerous possibilities of deviation and of change in direction enabling to adapt simply and cheaply to an existing or new plant, by using halls of smaller lengths and fewer lifting means than in a conventional installation.

The invention relates therefore to a guiding device of a band-type product running along a longitudinal axis and comprising at least two conical deflectors each having a narrow end and a wide end and arranged head to foot, the narrow end of one of the deflectors being situated on the same side, relative to the axis of the band, as the wide end of the other deflector.

According to the invention, each deflector comprises a fixed base whereon are mounted, in the manner of satellites, a plurality of guiding rolls distributed on a deviation angular sector of the deflector and mounted rotatably around axes forming the same angle (A) with an axis of the deflector and, the band being stressed on each deflector, along a virtual conical surface going through an outer generatrix of each roll, the axes of the deflectors are oriented relative to the longitudinal axis of running of the band so that the latter comprises successively, in the running direction, a upstream portion tangent to an input generatrix on a first deflector and having an axis perpendicular to said input generatrix, a central portion tangent, upwardly to an output generatrix of the first deflector and, downwardly, to an input generatrix on the second deflector and having an longitudinal axis perpendicular to said, respectively, output and input generatrices, and a downstream portion tangent to an output generatrix of the second deflector and having an longitudinal axis perpendicular to said output generatrix.

Thanks to this arrangement, the band may be subject to a traction load determined in relation to the rigidity of the band in order to generate a stress with elastic deformation of the band on the set of rolls of each of the deflectors, the head to foot assembly of said deflectors compensating for the differences in elongation of both sides of the band, on either side of the longitudinal axis and defining a centring effect of the band with gradual rotation of its longitudinal axis capable of keeping the former perpendicular with the outer generatrix of each roll of the deflector.

Thus, the traction load applied to the band is distributed over the width thereof while increasing gradually from its inner edge situated on the narrow side of the deflector to the outer edge situated in the wide side, with gradual lengthening of the longitudinal fibres of the band, so that the tangential running speed of each fibre along an outer generatrix of each satellite roll remains substantially constant from one edge to the other.

In a preferred embodiment, each roll of a deflector exhibits a cambered outer profile, with a central portion of slightly greater diameter than the ends, and the traction load applied to the band defines self-centring of the band whereof the longitudinal axis is kept in the central portion and orthogonal to the outer generatrix of each roll of the deflector.

According to another preferred feature, the device comprises an even number of deflectors associated two by two, both deflectors of each pair having the same tilting angle (A) of the guiding rolls.

In a first embodiment of the invention, the axes of two successive deflectors are oriented so that the output generatrix of the first deflector and the input generatrix on the second deflector are parallel and placed in the same tangent plane common to both two deflectors, wherein extends the central portion of the band.

But, in another embodiment, the output generatrix of the first deflector and the input generatrix on the second deflector are placed in two planes parallel to one another and perpendicular to the axis of the central portion of the band and delineate together a non-zero angle, said generatrices being spaced by sufficient distance so that the longitudinal median plane of the central portion revolves gradually around of the axis.

Preferably, both deflectors are placed on the same side of the band and reverse therefore the running direction.

In such a case, a cylindrical roll enables to come back to the first direction. But it is also possible to place both deflectors on either side of the band whereof the running direction is then kept.

Besides, the invention enables to vary, on the one hand, the angle at the apex of the deflectors, and on the other hand, their relative positions and their orientations in order to define a lateral offset or an angular deviation of the band.

Particularly advantageously, two successive deflectors are arranged so that the input generatrix on the first deflector, and the output generatrix of the second deflector are placed in two parallel running planes, respectively of the upstream portion and of the downstream portion and that the longitudinal axes of said upstream and downstream portions are spaced apart, at said input and output generatrices, by a distance $$D=H \text{ tg } A,$$

A being the angle at the apex of each deflector and H the distance between both running planes, respectively upstream and downstream of the band.

In a first embodiment, the generatrices, respectively the input generatrix on the first deflector and the output generatrix of the second deflector are parallel, the upstream portion and the downstream portion of the band being centred, respectively, on two longitudinal median planes parallel to one another and spaced by the distance D=H tg A.

In another embodiment, the axes of both deflectors are oriented so that the input generatrix on the first deflector and the output generatrix of the second deflector delineate together a non-zero angle, the upstream portion and the downstream portion of the band being centred, respectively, on two longitudinal median planes delineating together the same non-zero angle.

It can be seen therefore that the invention provides numerous possibilities enabling to adapt to most diverse situations.

But the invention will be understood better by the following description of certain particular embodiments, given for exemplification and non-limiting purposes, and represented on the appended drawings.

FIG. 6 shows a perspective view of an angular deviation device.

FIG. 7 shows an angular deviation device of two substantially horizontal belts.

FIG. 8 is side view of the device of FIG. 7.

FIG. 9 is a top view of the assembly of the device of FIG. 7.

As indicated, until now, it had appeared natural, in band guiding devices and, in particular, in metal band guiding devices, to use deflector rolls having a cylindrical profile and revolving around an axis orthogonal to the longitudinal running axis of the product. In such a case, the deflector roll modifies the direction of the running plane of both portions, respectively upstream and downstream of the band, tangent to the deflector rolls, but the latter remain centred in the same longitudinal median plane orthogonal to the axis of rotation of the cylindrical roll.

As indicated above, the use of conical deflectors enables to realise an angular deviation of the longitudinal median plane of the band but the arrangements provided until now were rather complex and exhibited certain shortcomings.

Figure 1:
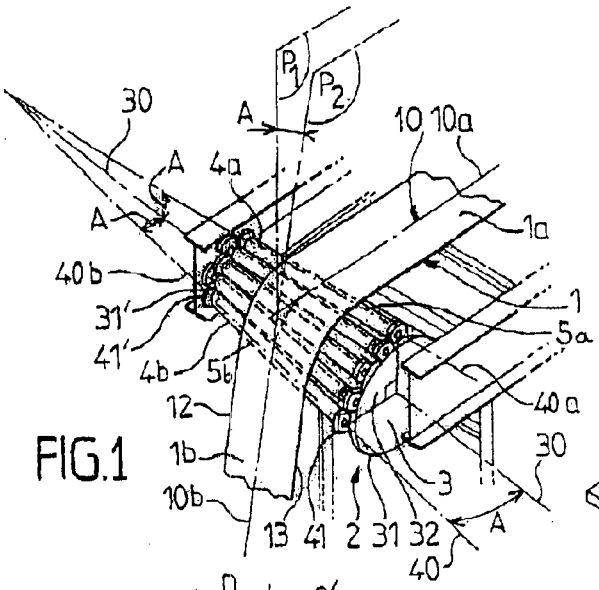
FIG. 1 shows a perspective view of a deflector with satellite rolls according to the invention.

To solve these problems, the invention concerns a new type of conical deflector composed, as shown on FIG. 1, of a fixed base 3 carrying a plurality of cylindrical rolls 4 distributed over its periphery in the manner of satellites Each satellite roll 4 is mounted rotatably around an axis 40 on two bearings 41, 41' housed in fixed casings, respectively, on two ends, respectively widened 31 and narrowed 31' of the base 3 which, in the example represented is delineated by a conical revolution face 33 around an axis 30, having an angle A at the apex. It should be noted that only the rolls 4 turn around their axis under the action of the band 1, the support 3 being fixed. Moreover, since it does not revolve with the band, the base 3 carries rolls 4 only on an angular winding sector 32 of the band 1. Consequently, the conical face 33 supporting the rolls 4 might be limited to this angular sector 32 which, most often will cover substantially a quadrant.

The axes of the rolls 4 are parallel to that conical face 33 and are therefore themselves placed on a virtual conical surface centred on the same axis 30 and having the same angle A at the apex.

As the band 1 winds around the deflector 2, it rests upon each roll 4 along an outer generatrix 5 opposite to the base 3 and parallel to the axis 40 of the roll and to the conical face 33 of the base 3.

Consequently, the band 1 revolves around the deflector 2 by following a virtual conical surface 43, symbolised as a mixed line on FIG. 6, going through the back-up generatrices 5 by enveloping the set of rolls 4.

Thus, the band comes in contact with the deflector 2 only along the outer generatrices 5 of the rolls 4, each revolving around its axis 40.

Besides, the band to be guided is, normally, a metal band which, taking its rigidity into account, must be subject to a significant traction to be applied to the deflector. According to another feature of the invention, the axis 30 of the deflector is oriented relative to the general running direction of the band so that the axis 10*a* of the upstream portion 1*a* of the latter is perpendicular to the outer generatrix 5*a* of the first roll 4*a* and that the axis 10*b* of the downstream portion 1*b* is perpendicular to the outer generatrix 5*b* of the last roll 4*b* in the series.

Since the band is realised in an elastoplastic material such as a metal and is held under tension, it may be deviated gradually while remaining orthogonal to each roll and while being deformed elastically between two successive rolls, the elongation ratio of the longitudinal fibres of the band increasing gradually from its inner edge 12 turned toward the narrower end 31' of the base 3 up to the outer edge 13 turned toward the widened end 31.

Thanks to this increased elongation ratio, the running speed of the different longitudinal fibres of the band remains constant and equal to the tangential speed of the roll 4 at each point of the back-up generatrix 5.

Besides, this variation in the elongation ratios of the longitudinal fibres of the band is compensated for in a guiding device according to the invention which comprises two deflectors 2, 2' having the same angle A at the apex and placed head to foot, as represented on the other figures, the narrow end of one lo of the deflectors 2 being situated on the same side as the wide end of the other deflector 2' relative to the longitudinal running axis of the band.

Thus, as shown on FIG. 6, between two successive rolls 4*i*, 4*j*, the longitudinal axis 10 of the band revolves by an angle i equal to the angle between the axes of both rolls.

Thus, on each roll, the running axis of the band 1 is rectilinear, while remaining orthogonal to the axis 30 of the conical deflector, the band still centred on each satellite roll 4 and being deforming elastically between each pair of two successive rolls.

Moreover, according to another preferred and particularly advantageous feature of the invention, the profile of each roll 4 is not rigorously cylindrical, but may be slightly cambered, the diameter of its central portion 44 being a little greater than that of the ends 42.

There is thus provided a self-centring effect analogous to that which is used in the belt-driving devices whereof the rolls are slightly cambered in order to avoid any axial offset of the belt revolving at high speed.

Figure 3:
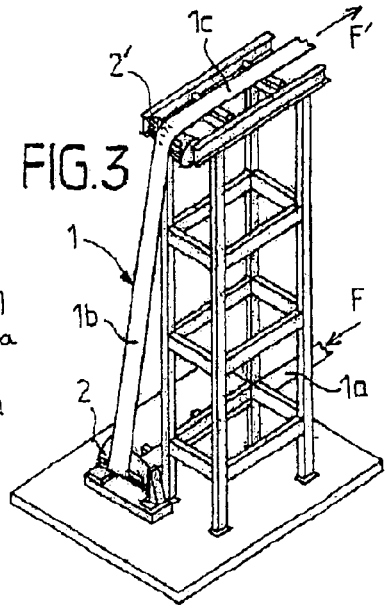
FIG. 3 shows a perspective view of the device of FIG. 2.
Figure 2:
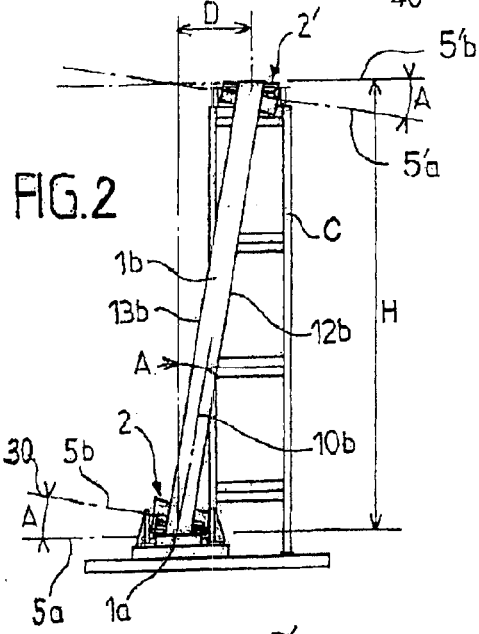
FIG. 2 is a front view of a two-deflector device according to the invention.

For exemplification purposes, FIG. 2 shows a front view, such a guiding device being represented in perspective on FIG. 3, and comprising two deflector members 2, 2' mounted on a framework C, at two different levels.

Each deflector 2, 2' is of the type represented on FIG. 1 and comprises therefore a base 3 centred on an axis 30 and whereon are mounted a plurality of satellite rolls 4 each revolving around an axis forming, with the axis 30 of the base, an angle A which constitutes the angle at the apex of the conical deflector.

In the embodiment of FIGS. 2 and 3, both deflectors 2, 2' have parallel axes which are tilted of the same angle A relative to the horizontal. Thus, as can be seen on FIG. 3, the band 1 which reaches a lower level following a running direction F, passes successively over both deflectors 2, 2' and resumes its movement in the opposite direction F', at a higher level.

As shown on FIG. 2, the axis 30 of the lower deflector 2 is parallel to the plane of the figure and tilted relative to the horizontal of the angle A at the apex. The portion 1*a* of the band arriving upstream of the lower deflector 2 is therefore centred on a horizontal axis perpendicular to the plane of the figure and to the lower generatrix 5*a* of the deflector 2 which constitutes the input generatrix on the latter. The band winds around the lower deflector 2 while being deformed elastically, and its central portion 1*b* comprised between both deflectors 2, 2' is centred on an axis 10*b* perpendicular to the output generatrix 5*b* placed in a plane which is titled by the angle A relative to the horizontal. The longitudinal axis 10*b* of the central portion 1*b* is therefore tilted by the same angle A relative to the vertical and perpendicular to the input generatrix 5'*a* on the second deflector 2', which is itself placed in a tilted plane of the same angle A relative to the horizontal.

The band 1 then winds around a quadrant of the upper deflector 2' and its downstream portion 1*c* comes out of the device following a horizontal direction F' perpendicular to the plane of FIG. 2 and to the output generatrix 5'*b* of the upper deflector 2'.

Thanks to this arrangement, the running directions F, F' of both portions, respectively upstream 1*a* and downstream 1*c* of the band 1 remain parallel but are spaced transversally by a distance D such that:

$$D=H.tg\ A,$$

H being the difference in level between the generatrices, respectively the input generatrix 5*a* and the output generatrix 5'*b* of both deflectors 2, 2' and A the angle at the apex of each of said deflectors.

It should be noted that the output generatrix 5*b* of the first deflector 2 and the input generatrix 5'*a* on the second deflector 2' are not parallel. The central portion 1*b* of the band is therefore subject to a slight twist which does not exhibit, however, any drawbacks if the height H is big relative to the width of the band.

If this difference in level does not correspond to the implantation of the different sections of the treatment line, it is possible to pass the band over cylindrical rolls of conventional type in order to bring it back to the required level, while keeping, however, the misalignment D.

Similarly, passing over a cylindrical roll enables to restore the general running direction if the latter ought to be preserved.

Any way, the longitudinal axis 10*b* being perpendicular to both generatrices, respectively the output generatrix 5*b* and the input generatrix 5'*a,* both edges 12*b,* 13*b* of the central portion 1*b* of the band have the same length and the head to foot assembly of both deflectors 2, 2' enables to compensate for the differences in elongation along each conical deflector, so that the paths followed by the different longitudinal fibres of the band have the same length.

As indicated above, the use according to the invention, of deflector members having a conical winding surface provides multiple arrangement possibilities of said conical deflectors whereof the number and the orientations may be changed in order to meet optimally the implantation requirements of the different sections of an installation, in particular for modernising an existing installation.

Figure 10:
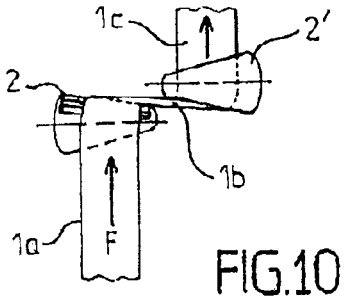
FIG. 10 shows an example of a deflector band arrangement.

Consequently, in the case of FIGS. 2 and 3, both conical deflectors 2, 2' rest on the same face of the band while reversing the running direction. Conversely, if both deflectors 2, 2' rest on both opposite faces of the band 1 as shown in FIG. 10, the incoming belt 1*a* and the outgoing belt 1*c* run in the same direction and are simply offset transversally, which enables, for example to by-pass a portion of the framework of the building wherein is placed the installation.

Figure 4:
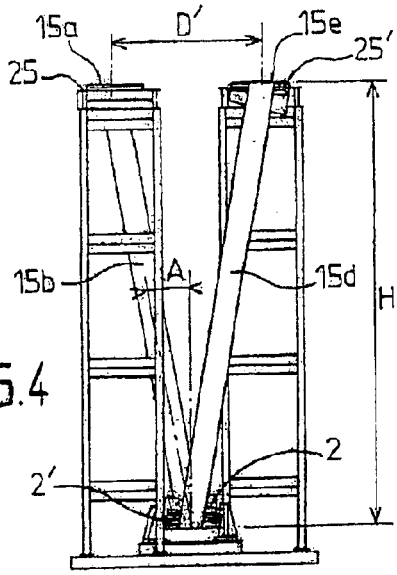
FIG. 4 shows a front view of a four-deflector lateral offset device.
Figure 5:
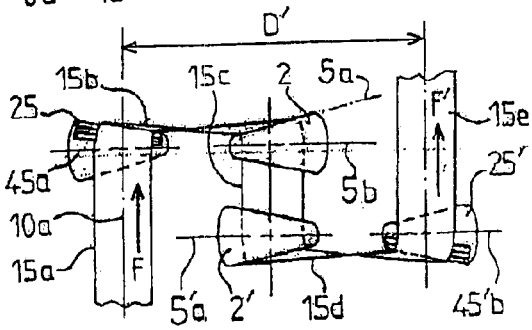
FIG. 5 is a top diagrammatical view of the device of FIG. 4.

For exemplification purposes, FIGS. 4 and 5 show another arrangement enabling to provide a significant transversal offset on both parallel belts of the band running in the same direction.

In such a case, both deflectors 2, 2' placed head to foot are used at the same level and associated to two other deflectors 25, 25' placed at a higher level.

In the embodiment represented, the axes of all the deflectors 25, 2, 2', 25' are placed in vertical planes parallel to the plane of FIG. 6 and are oriented so that, in the order of succession of the deflectors, the input generatrices of the odd order members and the generatrices output of even order members are all horizontal and parallel.

Thus, as shown on FIG. 5 which is a bottom view of the arrangement of FIG. 4, the band 1, which winds successively around each of the four deflectors 25, 2, 2', 25', comprises an input belt 15*a* which arrives following the running direction F and is tangent to a horizontal input generatrix 45*a* of the first conical deflector 25, a descending oblique belt 15*b,* a horizontal belt 15*c,* an ascending oblique belt 15*d* and an output belt 15*e* tangent and perpendicular to an output generatrix 45'*b* of the last deflector 25'.

It can be seen that the odd-numbered input generatrices 5*a* and 5'*a,* respectively on the first 25 and the third deflector 2' and the even-numbered output generatrices, respectively 5*b* of the second deflector 2 and 45'*b* of the four deflector 25', are all horizontal and parallel to one another so that the incoming belt 15*a* and the outgoing belt 15*e* run horizontally and in the same direction along parallel directions F, F'.

Conversely, the oblique belts 15*b,* 15*d* are slightly twisted but this twisting effect does not exhibits any drawbacks if the difference in level H between the input and output generatrices of each pair of deflectors, respectively 25, 2 and 2', 25' is big relative to the width of the band 1.

Thanks to this arrangement, the misalignment D' between the incoming belt 15*a* and the outgoing belt 15*e* is such that:

$$D'=2H.tg\ A$$

A being the angle at the apex of the deviation members.

Relative to the arrangement of FIG. 2, such arrangement enables therefore to double the misalignment without modifying the running direction of the band.

It should be noted that, the rolls 25, 25' are not necessarily at the same level and that their positions can be adjusted relative to both lower rolls 2, 2' in order to realise the misalignment requested.

Obviously, the invention is not limited to the embodiments which have just been described for exemplification purposes, but also covers the equivalent arrangements within the framework of the claims.

For example, in the arrangement of FIGS. 2 to 4, both successive deflectors 2, 2' may be arranged so that the output generatrix 5*b* of the first deflector 2 and the input generatrix 5'*a* on the second deflector 2' are parallel and placed in the same running plane of the central portion 1*b* of the band. In such a case, the input generatrix 5*a* on the first deflector 2 and the output generatrix 5'*b* of the second deflector 2' are still placed in two parallel planes but delineate together an angle 2A', A' being the projection of the angle at the apex A on a horizontal plane. The directions F and F' of the upstream portion 1*a* and of the downstream portion 1*c* delineate together the same angle 2A'. It is therefore possible, if needed, to define an angular deviation of the longitudinal median planes of both portions of the band which, besides, are offset laterally, at both deflectors 2, 2' by the distance D'=2H.tg A.

Besides, as represented on FIGS. 7, 8 and 9, the vertical offset of both portions, respectively upstream 1*a* and downstream 1*c* of the band may be reduced in case when the central portion 1*b* remains flat.

Thus, as shown on FIG. 9, it is possible to realise a deviation angle of the order of double the angle at the apex A of both conical deviation members.

For an angle at the apex A of 22°30, a deviation angle of approximately 45° may then be realised.

However, many other arrangements are possible.

For example, in the case of the arrangement of FIG. 6, both deflectors may be placed so that the intermediate belt is horizontal.

On the other hand, in case when both deflectors 2, 2', are spaced apart sufficiently to admit a slight twist of the intermediate belt 1*b*, the axes of the bases 3, 3' may be oriented in order to increase the deviation angle between the input and output generatrices and, consequently, between the axes 10*a*, 10*c* of the incoming belt 1*a* and of the outgoing belt 1*c*.

Besides, the angular sector 32 whereby the band is applied on a deflector need not be a right angle and the input 1*a* and output 1*c* belts need not be horizontal but simply form, on the contrary, an ascending or descending ramp.

The invention provides therefore numerous possibilities for arranging successive sections of a treatment installation, in particular for the realisation of a continuous line in an existing plant.

The reference signs inserted after the technical features mentioned in the claims solely aim at facilitating the understanding thereof and do not limit their extent whatsoever.

What is claimed is:

1. Device for guiding a band material running along a longitudinal axis and comprising at least two conical deflectors each having a narrow end and a wide end and arranged head to foot, the narrow end of one of the deflectors being situated on the same side, relative to the axis of the band, as the wide end of the other deflector, wherein each deflector comprises a fixed base whereon are mounted, in the manner of satellites, a plurality of guiding rolls distributed on a deviation angular sector of the deflector and mounted rotatably around axes forming the same angle (A) with an axis of the deflector, that the band is stressed on each deflector along a virtual conical surface going through an outer generatrix of each roll and that the axes of the deflectors are oriented relative to the longitudinal running axis of the band so that the band comprises successively, in the running direction, an upstream portion tangent to an input generatrix on a first deflector and having an axis perpendicular to said input generatrix, a central portion tangent, upwardly to an output generatrix of the first deflector and, downwardly, to an input generatrix on the second deflector and having a longitudinal axis perpendicular to said generatrices, respectively the output generatrix and the input generatrix, and a downstream portion tangent to an output generatrix of the second deflector and having a longitudinal axis perpendicular to said output generatrix.

2. A guiding device according to claim 1, wherein the band is subject to a traction load determined in relation to the rigidity of the band in order to generate a stress with elastic deformation of the band on the set of rolls of each deflector, the head to foot assembly of said deflectors compensating for the differences in elongation, on each deflector, between both sides of the band, on either side of the longitudinal axis and defining a centering effect of the band with gradual rotation of its longitudinal axis capable of keeping the former perpendicular with the outer generatrix of each roll of the deflector.

3. A guiding device according to claim 2, wherein each portion of the band applied on a deflector shows an inner edge of the side of the narrowed end of the deflector and an outer edge of the side of the widened end, and the traction load applied to the band is distributed over the width thereof while increasing gradually from the inner edge to the outer edge, with gradual lengthening of the longitudinal fibers of the band, so that the tangential running speed of each fiber, along an outer generatrix of each roll, is substantially constant from one edge to the other.

4. A guiding device according to any of claims 1, 2, or 3, wherein each roll of a deflector exhibits a cambered outer profile, with a central portion of slightly greater diameter than the ends, and the traction load applied to the band defines self-centering of the band whereof the longitudinal axis is kept in the central portion and orthogonal to an outer back-up generatrix on each roll of the deflector.

5. A guiding device according to any of claims 1, 2, or 3, wherein, the band is applied to an angular sector of approximately one quadrant of each deflector.

6. A guiding device according to claim 1 which comprises an even number of deflectors associated two by two, both deflectors of each pair having the same tilting angle (A) of the guiding rolls.

7. A guiding device according to claim 6, wherein the axes of two successive deflectors are oriented so that the output generatrix of the first deflector and the input generatrix on the second deflector are parallel and placed in a same tangent plane common to both deflectors wherein extends the central portion of the band.

8. A guiding device according to one of the claims 1 to 3, wherein the output generatrix of the first deflector and the input generatrix on the second deflector are placed in two planes parallel to one another and perpendicular to the axis of the central portion of the band and that said output and input generatrices delineate together a non-zero angle.

9. A guiding device according to claim 1, wherein both deflectors rest on two opposite faces of the band and define a lateral offset of the longitudinal axis of the downstream portion of the band relative to that of the upstream portion, while keeping a same general running direction of the band.

10. A guiding device according to claim 1, wherein both deflectors rest on the same face of the band, and define a lateral offset of the longitudinal axis of the downstream portion of the band relative to the longitudinal axis of the upstream portion, with a reversal of a running direction of the band.

11. A guiding device according to any one of claims 9 or 10, wherein both deflectors are arranged so that the input generatrix on the first deflector and the output generatrix of the second deflector are placed in two parallel running planes, respectively of the upstream portion and of the downstream portion of the band and that the longitudinal axes of said upstream and downstream portions are spaced apart, at said input and output generatrices, by a distance $$D=H \text{ tg } A,$$

A being the angle at the apex of each deflector and H the distance between both running planes, respectively upstream and downstream of the band.

12. A guiding device according to any one of claims 9 or 10, wherein both deflectors are arranged so that the output generatrix of the first deflector is parallel to the input generatrix on the second deflector, the central portion of the band being flat.

13. A guiding device according to claim 12, wherein the input generatrix on the first deflector and the output generatrix of the second deflector are parallel to the same plane and delineate together a second angle equal to two times the projection of the second angle at the apex of each deflector on said plane of the generatrices, the longitudinal median planes of the upstream and downstream portions of the band delineating together at the same angle.

14. A guiding device according to any one of claims 9 or 10 wherein both deflectors are arranged so that the input and output generatrices, respectively of the first deflector and of the second deflector are placed in parallel planes and delineate together a non-zero angle, the longitudinal median planes of the upstream and downstream portions of the band being perpendicular to said input and output generatrices and delineating together the same non-zero angle.

15. A guiding device according to claim 11, wherein the input generatrix on the first deflector and the output generatrix of the second deflector are parallel and that the upstream portion and the downstream portion of the band are centered, respectively, on two longitudinal median planes parallel to one another and spaced by the distance D=H tg A.

16. A guiding device according to claim 11, wherein both deflectors are arranged so that the output generatrix of the first deflector is parallel to the input generatrix on the second deflector, the central portion of the band being flat.

17. A guiding device according to claim 16, wherein the input generatrix on the first deflector and the output generatrix of the second deflector are parallel to the same plane and delineate together a second angle equal to two times the projection of the second angle at the apex of each deflector on said plane of the generatrices, the longitudinal median planes of the upstream and downstream portions of the band delineating together the same angle.

18. A guiding device according to claim 11, wherein both deflectors are arranged so that the input and output generatrices, respectively of the first deflector and of the second deflector are placed in parallel planes and delineate together a non-zero angle, the longitudinal median planes of the upstream and downstream portions of the band being perpendicular to said input and output generatrices and delineating together the same non-zero angle.

* * * * *